United States Patent [19]

Sawada et al.

[11] Patent Number: 4,685,793

[45] Date of Patent: Aug. 11, 1987

[54] IMAGE FORMING APPARATUS

[75] Inventors: Takamasa Sawada, Kawasaki; Junji Ihikawa, Kamakura, both of Japan

[73] Assignee: Canon Kabushiki Kaisha, Tokyo, Japan

[21] Appl. No.: 910,838

[22] Filed: Sep. 23, 1986

Related U.S. Application Data

[63] Continuation of Ser. No. 757,458, Jul. 22, 1985, abandoned.

[30] Foreign Application Priority Data

Jul. 26, 1984 [JP] Japan ..... 59-157889

[51] Int. Cl.[4] ..... G03G 21/00

[52] U.S. Cl. ..... 355/3 SH; 271/239; 271/240; 271/253

[58] Field of Search ..... 355/3 SH, 14 SH, 3 R; 271/234, 239, 253, 254, 240

[56] References Cited

U.S. PATENT DOCUMENTS 4,334,759 6/1982 Clausing ..... 355/3 SH 4,417,801 11/1983 Eiseman ..... 355/3 SH

*Primary Examiner*—R. L. Moses

*Attorney, Agent, or Firm*—Fitzpatrick, Cella, Harper & Scinto

[57] ABSTRACT

In an image forming apparatus for forming images at an image forming section after conveying sheet materials by the one side reference method, sheet materials of sizes smaller than a predetermined size are conveyed in accordance with a one side reference position, and sheet materials of sizes larger than the predetermined size are guided in accordance with a position shifted from the one side reference position.

7 Claims, 9 Drawing Figures

IMAGE FORMING APPARATUS

This application is a continuation of application Ser. No. 757,458 filed July 22, 1985, (now aband).

BACKGROUND OF THE INVENTION

The present invention relates to an image forming apparatus and, more particularly, to an image forming apparatus such as copying machines, laser beam printers, printers and the like having a conveyance guide means for guiding a sheet material by one side reference. A description will be made with reference to the case of a copying machine.

Conventionally, sheet materials are conveyed by a method using one side of each sheet material as a reference or by a method using the central portion of each sheet material as a reference. However, due to the simple structure required for the apparatus, one side reference method is more often adopted, and therefore in the image forming apparatus a separation belt is used at only one side of the photosensitive drum.

In the conventional apparatuses when the original image is of A4 size, it is formed on a sheet material of A4 size, and when the original image is of B5 size, it is formed on a sheet material of B5 size. For this reason, irrespective of the method adopted for conveying sheet materials, no problem of image arrangement occurs in this case.

In an image forming apparatus the one side reference type adopting the sheet separation method by a separation belt, when an original image of A4 size is to be formed on a sheet material of A4 size, no problem of image arrangement occurs. However, when an original image of A4 size is to be formed on a sheet material of, e.g., B4 size, the reproduced image is deviated to one side of the sheet material, providing a poor image arrangement.

SUMMARY OF THE INVENTION

The present invention has been made in consideration of the above situation and has its object to provide a novel image forming apparatus which is free from the problems of conventional apparatuses.

It is another object of the present invention to provide an image forming apparatus for conveying a sheet material by the one side reference method, wherein an original image of small size can be reproduced on a sheet material of large size with a good balance.

In order to adhieve the above objects of the present invention, there is provided an image forming apparatus comprising guide means for guiding a sheet material with reference to a predetermined one side reference position when sheet materials of a plurality of sizes below a predetermined size are conveyed, and for guiding sheet materials with reference to a reference position deviated from the one side reference position when sheet materials of sizes larger than the predetermined size are conveyed.

According to the present invention as described above, when an original image of a small size is to be formed on a sheet material of a large size, the position of the sheet material can be shifted with reference to an image forming means so that the original image of small size can be formed on the sheet material of large size with a good balance which does not necessarily mean the reproduced image is located at the center of the sheet material.

In addition, since the sheet material is shifted with respect to the image forming means in order to form an original image of small size on a sheet material of large size with a good balance, the image can be formed on a sheet material of large size be an image forming means for forming images on sheet materials of small size. Therefore, a compact apparatus can form images on sheet materials of large size.

DESCRIPTION OF THE PREFERRED EMBODIMENTS

The preferred embodiment of the present invention will be described with reference to the accompanying drawings. A description will be made with reference to the case of an electrophotographic copying machine to which the present invention is applicable.

Figure 1:
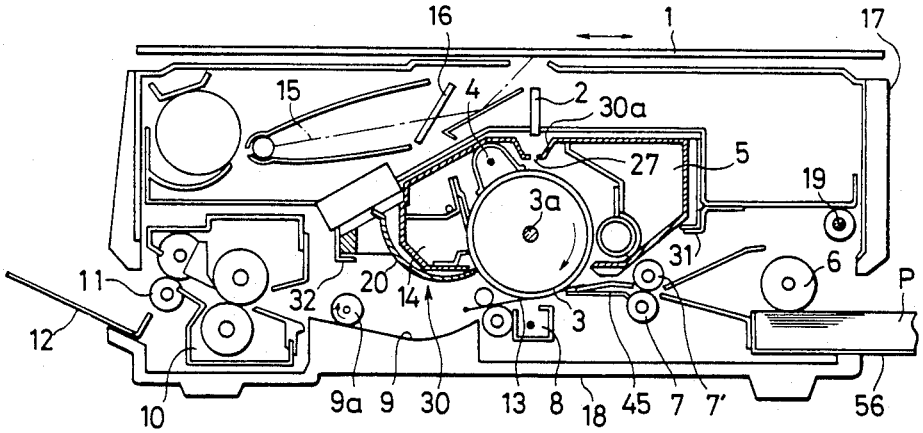
FIG. 1 is a sectional view showing a copying machine according to an embodiment of the present invention.
Figure 2:
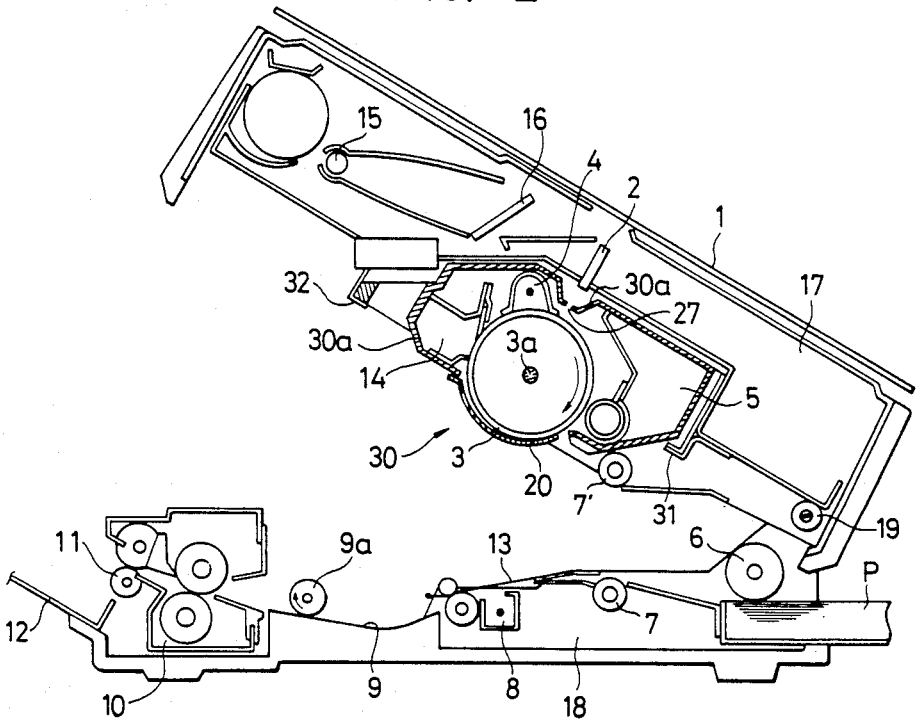
FIG. 2 is a sectional view of the copying machine shown in FIG. 1 in an open state.

FIGS. 1 and 2 are sectional views of an embodiment of an electrophotographic copying machine FIG. 2 shows the copying machine in a state wherein the main body is open. Referring to FIG. 1, an original table 1 comprising a transparent member is reciprocated in a direction indicated by arrows. An imaging element array 2 slit exposes an image of an original placed on the original table 1 onto a photosensitive drum 3. The drum 3 is rotated in the direction indicated by the arrow. A corona charger 4 uniformly charges the drum 3. A developer 5 develops with toner an electrostatic latent image formed by the array 2 on the drum 1 which is uniformly charged by the charger 4.

A transfer sheet P is supplied onto the surface of the drum 3 by a pickup roller 6 and register rollers 7 and 7'. The toner image on the drum 3 is transferred onto the transfer sheet 3 by a transfer charger 8. Thereafter, the sheet P is separated from the drum 3 by a separation belt 13 and is supplied to a fixing unit 10 by a roller **9*a* located at the convey end through a guide 9. The toner image on the sheet P is fixed by the fixing unit 10 and the sheet is thereafter discharged onto a tray 12 by a discharge roller 11. Residual toner on the drum 3 is recovered by a cleaner 14. An illumination system 15 illuminates an original, and a filter 14** is, for example, a heat absorbing filter.

Referring to FIG. 2, the copying machine is divided into an upper casing 17 and a lower casing 18 which are coupled through a pivot shaft 19. The upper casing 17 can be pivoted upward about the pivot shaft 19. An image forming means including the illumination optical system members 2 and 15, the photosensitive drum 3, the developing unit 5, the cleaner 14 and the like is arranged in the upper casing 17. The pickup roller 6, the transfer charger 8, the separation belt 13, the guide 9, and the fixing unit 10 are arranged in a sheet convey path in the lower casing 18.

In this embodiment, the image forming means including the developing unit 5, the cleaner 14, the charger 4 and the like around the drum 3 as an image carrier are formed integrally with each other and surrounded by a light-shielding wall 20 to constitute a process cartridge 30. When the drum 3 is replaced, the respective units in the cartridge 30 are also replaced to allow easy maintenance. Mounting/demounting of the process cartridge with respect to the machine main body can be performed by moving the cartridge 30 in a direction of a rotating axis 3*a* of the drum 3 (direction perpendicular to the sheet of drawing in FIG. 2) along rails 31 and 32 of the main body.

Figure 3:
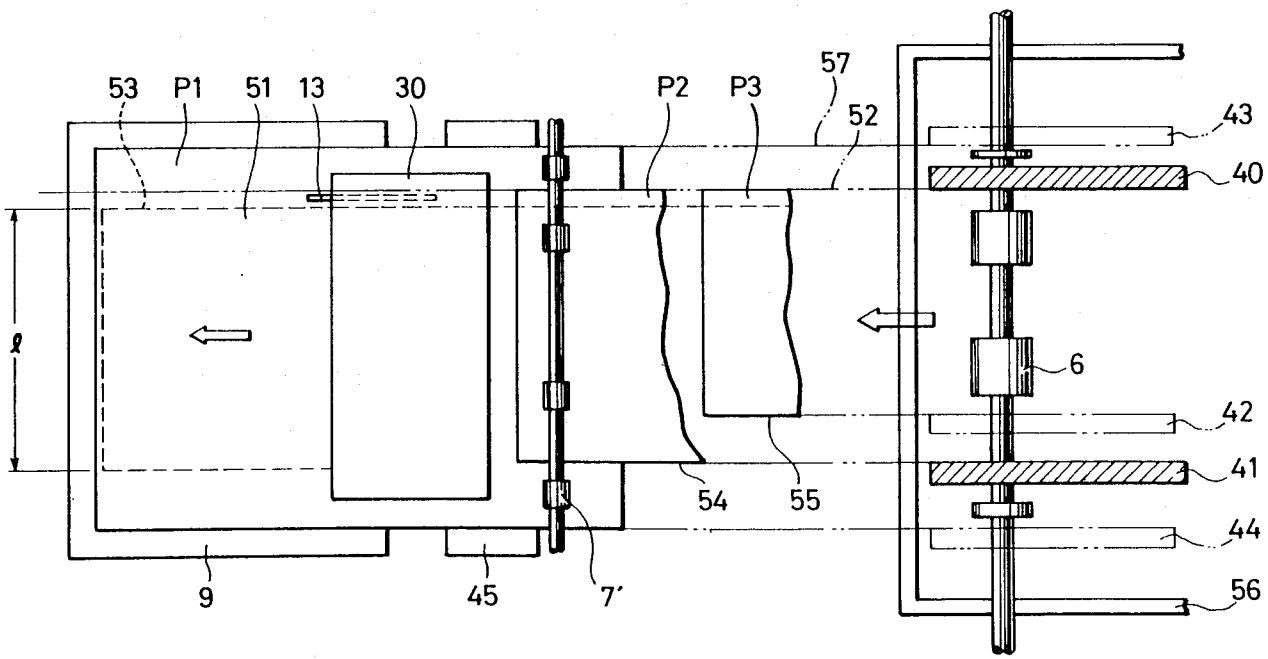
FIG. 3 is a plan view showing an embodiment of a convey section and an image forming section of an image forming apparatus according to the present invention.

This embodiment of the present invention will be described in detail with reference to FIG. 3.

Sheet materials P2 of A4 size which is a typical size used in this type of apparatus are stacked between sheet regulating plates 40 and 41 of a cassette 56. The sheet regulating plate 40 is aligned with a one side reference position 52.

When a copying instruction from the machine main body is received, the pickup roller 6 is rotated and the uppermost sheet P2 is conveyed into the main body.

The sheet P2 thus fed is conveyed into the process cartridge 30 in synchronism with the copying operation by the register rollers 7 and 7' and is conveyed to an image region (indicated by a region 51 inside a dotted line 53) of the process cartridge 30.

The sheet P2 is separated by the separation belt 13 located at the end face of the sheet and is guided thereby to the fixing unit. FIG. 3 shows the outer appearance of the cartridge 30 and constitutes an image forming section. The image forming section is for forming images on sheet materials of small size (A4).

When a sheet P3 of a size smaller than A4 size is to be conveyed, since the sheet regulating plate 40 in the cassette 56 is a reference position, its position is not changed. However, the other regulating plate is moved from the position 41 to 42 and sheets P3 are stacked between the regulating plates 40 and 42.

The sheet P3 fed into the main body is conveyed in the same manner as a sheet of A4 size. Since the position of the regulating plate 40 is not shifted, the sheet is separated by the separation belt 13 from the drum 3. Thus, a sheet P2 or P3 is conveyed by the regulating plate 40 in accordance with the one sheet reference method.

Image reproduction is performed for the entire image region except for the separation belt portion.

Conveyance of a sheet P1 of B4 size (large size) will now be described.

First, the sheet regulating plate 40 of the cassette as a reference for sheet conveyance is manually shifted to a position 43 (a reference position shifted from the one side reference position 52).

The other regulating plate 41 is also manually shifted to a position 44, and sheets P1 of B4 size are stacked between the plates 43 and 44.

At this time, the regulating plates 43 and 44 are set at the positions which substantially and symmetrically correspond to outer sides of the image region 51 of the process cartridge 30. When the sheet P1 of B4 size is guided and conveyed by the regulating plates 43 and 44, the sheet P1 is passed such that the image region 51 of the process cartridge 30 opposes the central position of the sheet P1. As a result, when an original image of A4 size is formed on a sheet P1 of B4 size, the image is formed (transferred) at the center of the sheet P1 of B4 size.

In this embodiment, a copying machine copies images on A4 size originals onto central portions (need not be the central portions and can be shifted therefrom) of sheets of B4 size. Therefore, an imaging region 51 (of width l) of the process cartridge 30 is set in accordance with the widths of the sheets of A4 and B5 sizes.

The cassette 56 will be described in detail with reference to FIGS. 4A and 4B.

In the cassette 56, the sheet regulating plates 41 and 40 oppose each other and are slidably mounted. Separation pawls 74 and 75 for separating a sheet are vertically slidably mounted on the regulating plates. A central plate 76 is inserted into holes 72' and notches 72'' formed in the plates 40 and 41. The central plate 76 has the holes 72' as its pivotal axis, and the distal end of the plate 76 is biased upward by compression springs 77 and stopped by the separation pawls 74 and 75. As shown in FIG. 4B, the plates 41 and 40 are slidably mounted on the cassette 56.

Figure 4A:
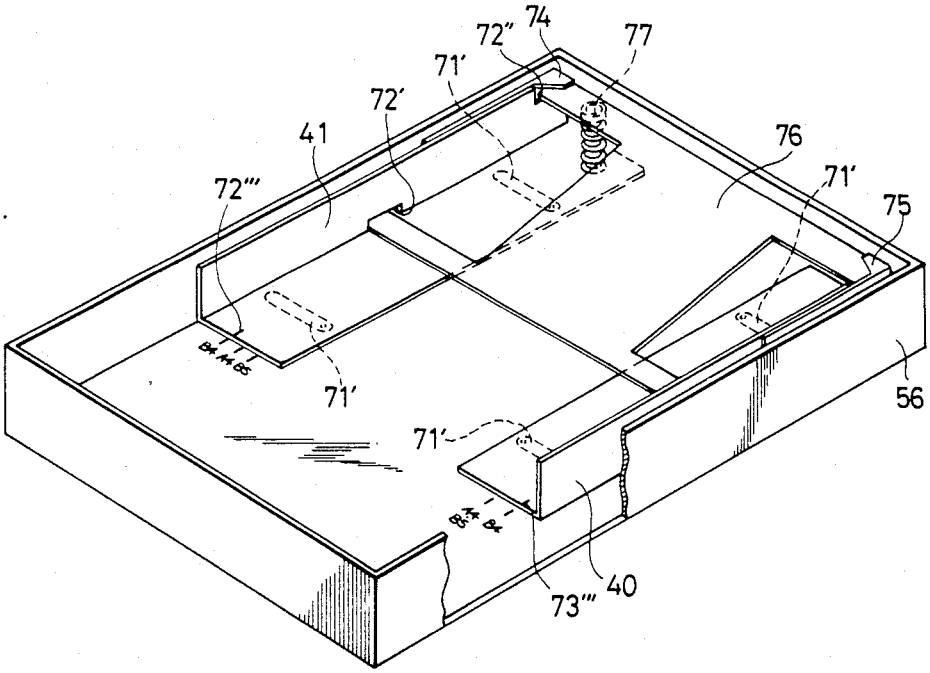
FIG. 4A is a perspective view of an embodiment of a cassette used in the present invention.
Figure 4B:
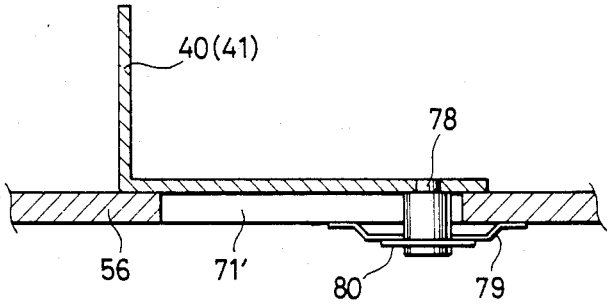
FIG. 4B is a partial sectional view of the cassette shown in FIG. 4A.

Four elongated holes 71' are formed in the cassette (FIGS. 4A and 4B). Two pins 78 are caulked to the regulating plate 40 through the holes 71'. Wave washers 79 are used to fix the regulating plate 40 through the cassette 56 therebetween, and washers 80 are used to prevent removal of the wave washers 79. The regulating plate 40 can be manually moved and is set at the position to which it is moved by friction between the cassette 56 and the wave washers 79. The other regulating plate 41 is of identical structure to that of the regulating plate 40. When sheets of B4 size are stacked in the cassette shown in FIG. 4A, a mark 72'' of the regulating plate 41 is aligned with a mark "B4" of the cassette 56 (the same applies to the regulating plate 40), and sheets of B4 size are stacked on the central plate 76. Then, the sheets are stacked between the regulating plates 40 and 41 and set at a predetermined position.

Sheets of A4 or B5 size can be similarly set at a corresponding position by setting the mark of the regulating plate to the corresponding mark.

Since parts of the sheet are conveyed outside the process cartridge 30 or image region 51, margins with no image are formed at the two sides of the sheet P1 of B4 size. Since the separation belt 13 is located inward from the end face of the sheet of A3 size, the sheet can be separated from the drum with ease.

The register rollers 7 and 7' and the pickup roller 6 are arranged to allow conveyance of sheets outside the image region 51 so as to allow conveyance of images of B5 to B4 sizes. The guide 9 and the guide plate 45 are arranged to correspond to the width of a sheet of B4 size so as to hold and guide it.

The above embodiment has been described with reference to sheets, of B4, A4 and B5 sizes. However, when sheets of A3 size which are larger than those of B4 size are to be used, the sheet regulating plates of the cassette can be moved outward from the positions 43 and 44. When the sheets of B5 size or of ever smaller size are to be conveyed, the regulating plates can be shifted inward further.

(i) As described above, in an image forming apparatus such as a copying machine, sheets with holes at the two sides such as line printer sheets can be separated by a separation belt. Such sheets with holes at the two sides are difficult to handle and cannot be normally separated by a separation belt. However, with the apparatus of the present invention, the portion of sheet to be guided can be shifted along the width of the sheet as in the case of sheets of B4 size. Then, such sheets can be separated at portions not having holes by the separation hole. If sheets with holes at the two sides are guided at portions with holes, paper dust tends to form. However, in the apparatus of the present invention, portions of sheets having holes will not be brought into contact with the photosensitive drum and therefore formation of an irregular image can be prevented.

(ii) Similarly, when an adhesive is attached to a side of a sheet, the sheet portion attached with the adhesive can be separated from the photosensitive drum.

(iii) Since sufficient margins can be formed at two sides of sheets, spaces for inserting sentences or binding margins can be guaranteed.

(iv) The process cartridge including the photosensitive drum can have a size smaller than the maximum size of the sheets. Thus, in the above embodiment, a common process cartridge can be used for A4 and B4 size machines.

Compact image forming apparatuses are more popular recently. With this trend, due to limitations as to the image size, price and the like, a photosensitive drum which is expensive and is difficult to handle although it is capable of stacking sheets of large width is not preferred and the size of the images is also limited. In view of this, the maximum size of an image to be formed is designed to be slightly smaller than the maximum size of sheets mountable from the viewpoint of cost effectiveness In compact image forming apparatuses, process cartridges are fequently used due to their small size and easy replacement, and proces cartridge have the above arrangement.

In order to transfer an image of A4 size to the center of a sheet P1 of B4 size, the image position of an original of A4 size can be adjusted. However, with this method, the image region of the process cartridge must be adjusted for a sheet of B4 size, and the advantage of item (iv) above cannot be obtained.

The present invention has been described with reference to an image forming apparatus such as a copying machine. However, the present invention can be similarly applied to a sheet processing apparatus equivalent to the copying machine. In addition, the sheet sizes described above are B4, A4 and B5. However, the present invention is not limited to this. The design of the apparatus can be freely adjusted in accordance with the sheets of various sizes to be conveyed, and the positions for shifting the sheet regulating plates 40 and 41 can be freely selected irrespective of the one side reference method or central reference method.

Figure 5:
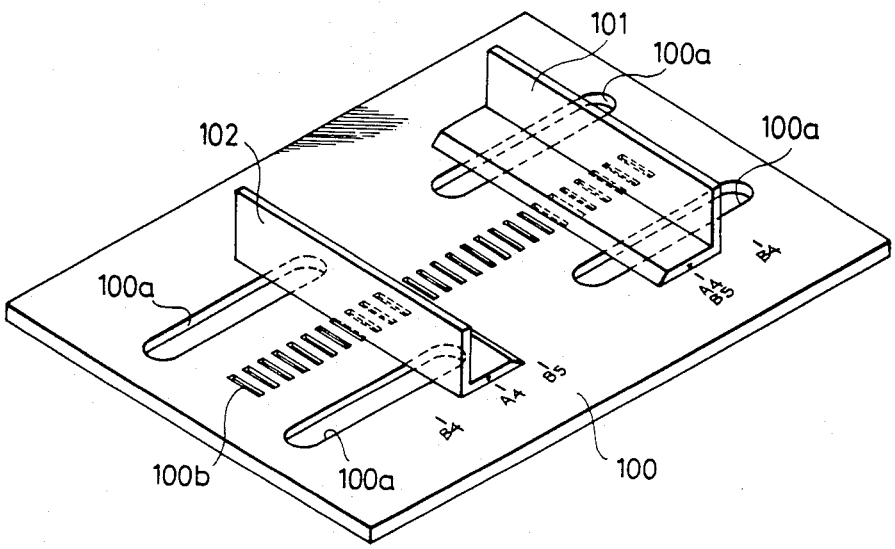
FIG. 5 is a perspective view of an embodiment of a manual feed tray of the present invention.

The present invention is not limited to a sheet stack device of cassette type and can be applied to a device of direct load type wherein sheets are directly loaded in a paper feed tray. FIG. 5 shows an embodiment to achieve this. Referring to FIG. 5, a sheet table 100 is arranged at the sheet feed port in place of a cassette 56 (FIG. 3). Sheet regulating plates 101 and 102 can be slid along the sheet table 100 and positioned at marks (A4, B5 and B4). Guide grooves 100*a* guide the sliding movement of the sheet regulating plates, and click grooves 100*b* determine the positions of the regulating plates 101 and 102.

Figure 6:
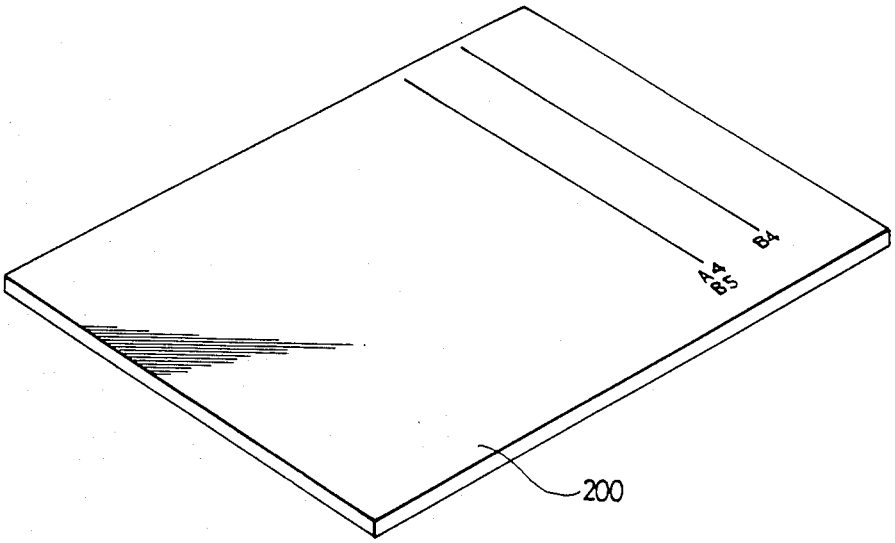
FIG. 6 is a perspective view of another embodiment of a manual feed tray.

As shown in FIG. 6, a sheet table 200 can simply have marks (A4, B5 and B4). In this case, sheets can be inserted through the sheet feed port in accordance with the marks. The guide means according to the present invention is not limited to guide means for guiding sheets in contact therewith but to a means for indicating the reference position.

Figure 7:
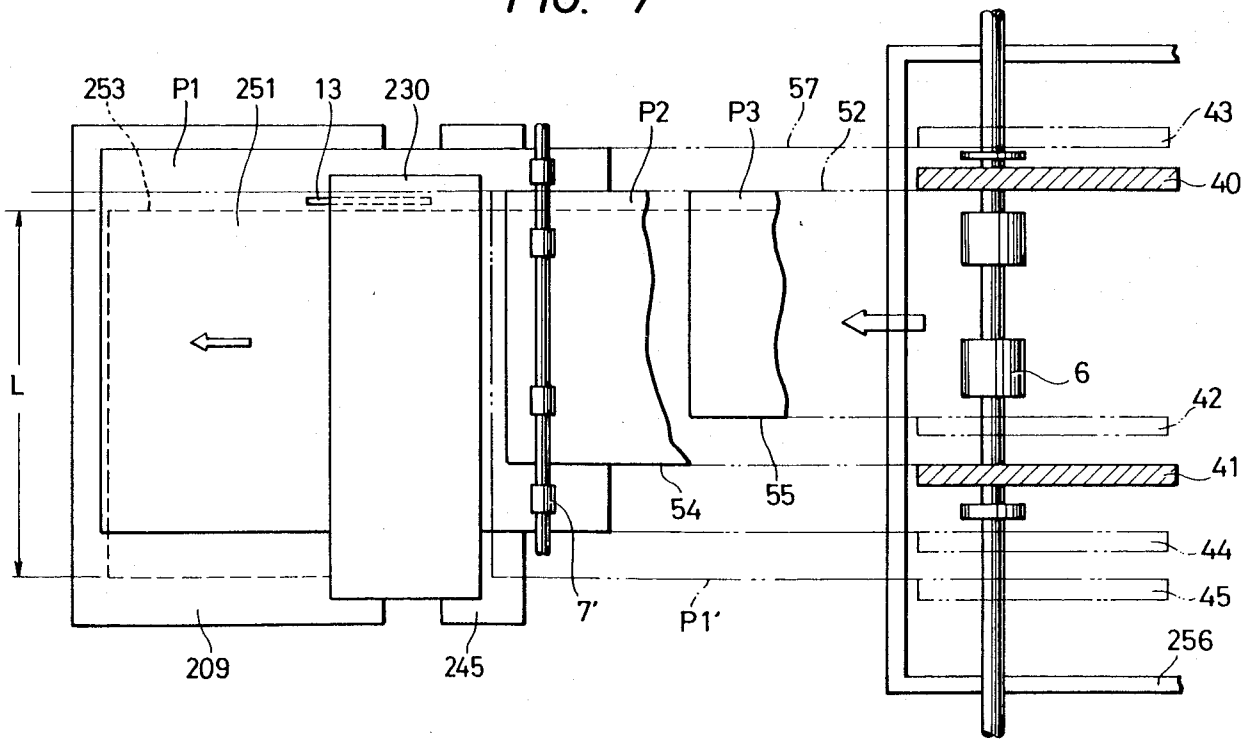
FIG. 7 is a plan view showing another embodiment of a convey section and an image forming section of the present invention.
Figure 8:
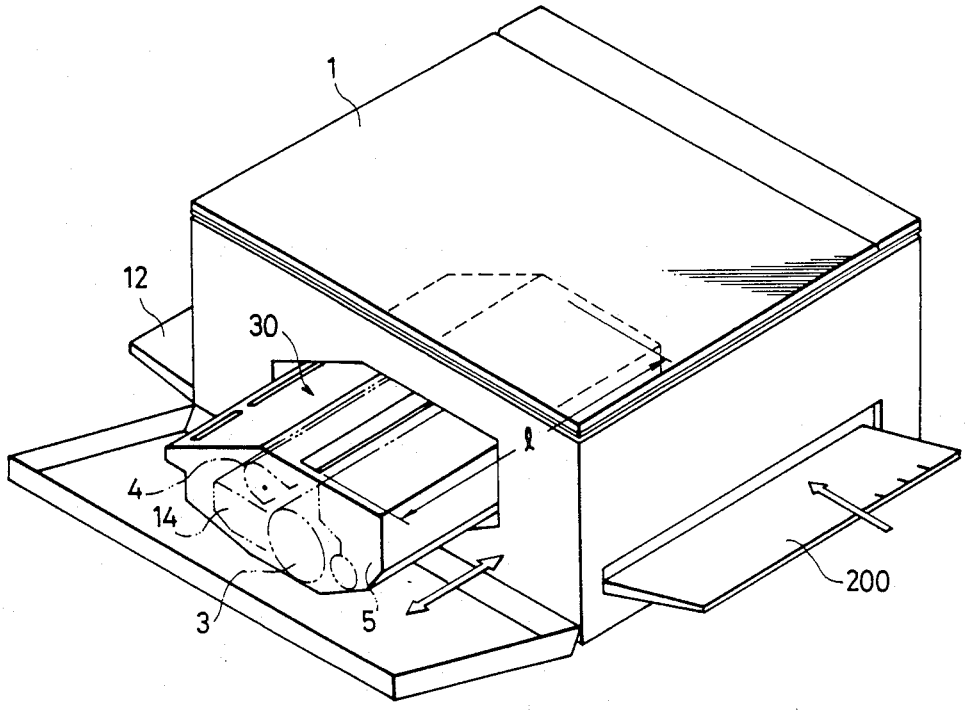
FIG. 8 is a perspective view of a process cartridge in a slightly pulled state.

The embodiment of the present invention is described with reference to the case of a copying machine for always forming images at the centers of sheets of B4 size. However, the present invention is not limited to this. An example of an alternative method is shown in FIG. 7. Referring to FIG. 7, an effective image forming region 253 (having a width L) of a process cartridge 230 is formed for sheets of B4 size. Therefore, in order to form images of A4 size at the centers of sheets of B4 size, sheet regulating plates can be shifted to positions 43 and 44. In order to form images of B4 size on sheets of B4 size, the sheet regulating plates can be set at positions 40 and 45.

We claim:

1. An image forming apparatus comprising: image forming means for forming an image on a sheet material;

means for conveying the sheet material to said image forming means; and guide means for guiding sheet materials with reference to one side reference position when sheet materials of sizes smaller than a predetermined size are to be conveyed and for guiding sheet materials with reference to a reference position shifted from the one side reference position when sheet materials of a size larger than the predetermined size are to be conveyed.

2. An apparatus according to claim 1, wherein said image forming means has a width which corresponds to a width of a sheet material of a size smaller than that of a sheet material of a maximum size usable.

3. An apparatus according to c1aim 1, wherein said image forming means has a width which corresponds to a width of a sheet material of a maximum size usable.

4. An apparatus according to any one of claims 1 to 3, wherein said image forming means has transfer means adopting an electrophotographic method.

5. An apparatus according to claim 4, wherein sheet material separating means is fixed to oppose an end of said image forming means which is at the side of the one side reference position.

6. An apparatus according to claim 5, wherein image forming means comprises a process cartridge which has at least a photosensitive body and is detachably mounted on an apparatus main body.

7. An image forming apparatus comprising:

image forming means for forming an image on a sheet material;

means for conveying the sheet material to said image forming means; and guide means for guiding sheet materials with reference to one side reference position when sheet materials of sizes smaller than a predetermined size that corresponds to a maximum width of an image forming area of the image forming means are to be conveyed and for guiding sheet material with reference to a reference position shifted from the one side reference position when sheet materials of sizes larger than the predetermined size are to be conveyed.

* * * * *

UNITED STATES PATENT AND TRADEMARK OFFICE

CERTIFICATE OF CORRECTION

PATENT NO. : 4,685,793

DATED : August 11, 1987

INVENTOR(S) : TAKAMASA SAWADA, ET AL.

It is certified that error appears in the above-identified patent and that said Letters Patent is hereby corrected as shown below:

Column 1, line 5, change "aband." to --abandoned--;

line 50, change "adhieve" to --achieve--.

Column 5, line 40, change "proces" to --process--; same line, change "cartridge" to --cartridges--.

Column 6, (lines 49 and 63),

Claim 6, line 1, after "wherein" insert --said--.

Claim 7, line 11, "material" should read --materials--.

Signed and Sealed this

Eighth Day of December, 1987

*Attest:*

DONALD J. QUIGG

*Attesting Officer*

*Commissioner of Patents and Trademarks*